US006308775B1

(12) United States Patent
Naumann

(10) Patent No.: US 6,308,775 B1
(45) **Date of Patent: *Oct. 30, 2001**

(54) HEAT EXCHANGER TUBE

(75) Inventor: Ulrich Naumann, Menden (DE)

(73) Assignee: KM Europa Metal AG, Osnabuck (DE)

( * ) Notice: Subject to any disclaimer, the term of this patent is extended or adjusted under 35 U.S.C. 154(b) by 391 days.

(21) Appl. No.: 08/829,699

(22) Filed: Mar. 26, 1997

(30) Foreign Application Priority Data

Mar. 28, 1996 (DE) ..... 196 12 470

(51) Int. Cl.[7] ..... F28F 13/18
(52) U.S. Cl. ..... 165/133; 165/184
(58) Field of Search ..... 165/133, 184

(56) References Cited

U.S. PATENT DOCUMENTS 5,458,191 10/1995 Chiang et al. .

*Primary Examiner*—Allen Flanigan
(74) *Attorney, Agent, or Firm*—Kenyon & Kenyon

(57) ABSTRACT

The exchanger tube has a smooth outside surface and a structured inside surface. The inside surface is formed from parallel primary and secondary ribs that run at an angle with respect to the longitudinal tube axis and respectively comprise inclined, planar flanks, channels that are limited laterally by the primary and secondary ribs and troughs shaped into the primary and secondary ribs. The radial extension of the secondary ribs is less than that of the primary ribs. The troughs are triangular. The center longitudinal planes of the troughs are disposed at an angle with respect to the longitudinal tube axis. The summits of the primary and secondary ribs are rounded. Rounded chamfers are provided between the flanks of the primary and secondary ribs and the channel beds.

27 Claims, 5 Drawing Sheets

Performance Comparison of Coaxial Condensers
Equipped with Different Inside Tubes Operating Conditions:

refrigerant: R22 (through the inside tubes)

| | |
|---|---|
| condensation temperature | = 45 °C |
| condensation undercooling | = 5 K |
| cooling medium: water - entry temp. | = 35 °C |

Tube Dimensions:

| | |
|---|---|
| coaxial cladding tube | 42 X 1.5 mm |
| identical inner individual tubes | 9.52 X 0.30 mm |

Tube Types per Measurement Series:

(1) tube having inside profile according to the invention
(25) standard V-profile
(24) smooth tube

FIG.6

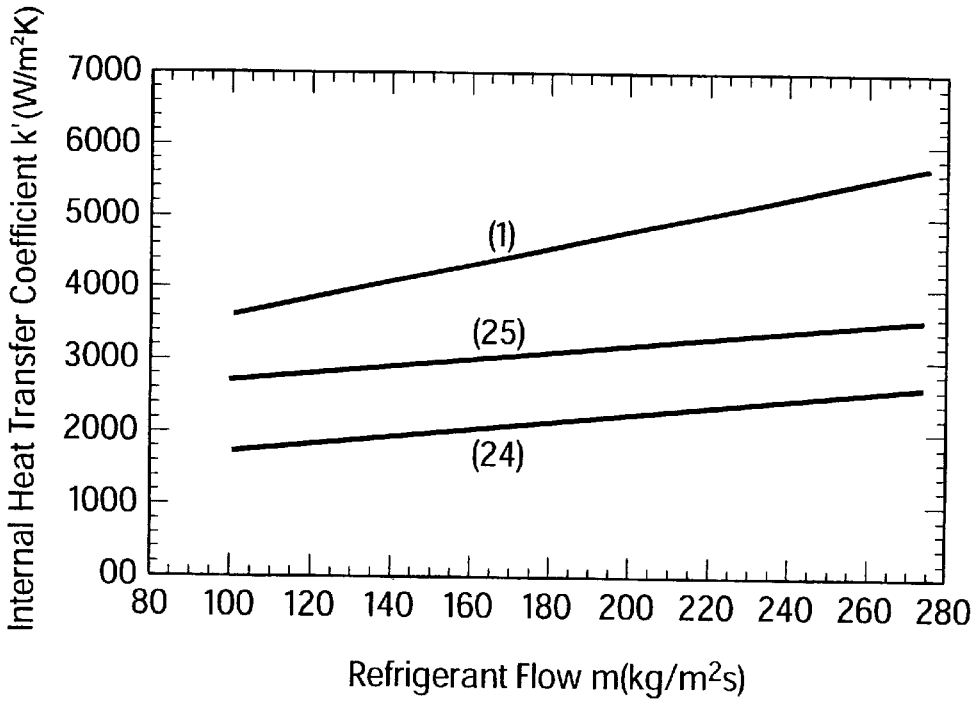

HEAT EXCHANGER TUBE

BACKGROUND OF THE INVENTION

The invention relates generally to an exchanger tube for a heat exchanger. More particularly, the invention relates to an exchanger tube of the type having a structured inner surface formed from ribs running at an angle with respect to the longitudinal tube axis and having inclined flanks and channels that are limited laterally by the ribs and troughs. These channels extend transversely through the ribs and also have inclined flanks, which extend at an angle with respect to the longitudinal tube axis.

An exchanger tube of this general type is described in EP 0 692 694 A2 (the corresponding U.S. Pat. No. 5,458,191 is incorporated herein by reference). In this case, both the ribs and the channels that are limited laterally by the ribs each have a trapezoidal cross section. The flanks of the ribs are planar, the transitions from the flanks to the channel beds are sharp-edged. Sharp-edged transitions are also present between the flanks and the level top sides of the ribs. The rib cross-sectional volume is dimensioned to be approximately one-half that of the channels. The parallel ribs extend at a 90° angle with respect to the longitudinal tube axis. All of the ribs have the same radial height.

The troughs extending transversely through the ribs likewise run at a 90° angle with respect to the longitudinal tube axis. The trough flanks are arched convexly. The transitions from the flanks to the level beds of the troughs, and to the level top sides of the rib regions between two adjacent troughs of a rib, are sharp-edged. The depth of the troughs is dimensioned to be less than the radial extension of the ribs. All of the troughs are of identical depth. In producing the troughs, the material formed from the ribs is shaped into the channels on the end face of the troughs.

The preferred method of producing the known exchanger tube is first to perform a rolling process to create the structure on one side of a metal band that will later be the inside surface, then shape the metal band into a slit tube with the surface structure on the inside, and then weld the slit edges together.

Because of the flat top sides and the level flanks of the ribs, in practical use the exchanger tube can be subject to the formation of condensate films that are difficult to remove and that retard condensation. Hence, blocking layers having thermally-insulating properties can form, leaving only a few edges available for developing steam bubbles for evaporation.

There remains a need for a heat exchanger tube having an inside surface structure with which a clearly more intensive channel flow-through can be assured, and which combines the advantages of uniformly good evaporation or condensation performance and a reduced rib weight.

SUMMARY OF THE INVENTION

The present invention addresses this need by providing an exchanger type having a structured inner surface that is formed of primary and secondary ribs running at an acute angle with respect to the longitudinal tube axis. The ribs have inclined flanks, and further serve to laterally delimit channels separating the rows of ribs from one another. A series of troughs is also provided. These troughs extend transversely through the ribs and have inclined flanks, which extend at an angle with respect to the longitudinal tube axis. Rows of these ribs are offset from one another by intermediately disposed secondary ribs. The primary ribs have a greater radial extent or height than the secondary ribs.

Because every other one of the primary and secondary ribs following one another in the circumferential direction now has a radial extension (height) that differs from the radial height of the adjacent secondary or primary rib, alternating high primary ribs and low secondary ribs are formed. This reduces the flow speed in the channels by only an insignificant amount. Nevertheless, more violent turbulence can arise at appropriate locations in the channels, ultimately intensifying the transfer of heat from the flowing fluid to the tube wall. Internal testing has revealed that the alternating heights of the primary and secondary ribs result in a marked increase in heat exchange performance.

In one embodiment, all of the primary ribs possess the same radial height, as do all of the secondary ribs. In other words, all of the primary ribs are of the same height, and all of the secondary ribs are of the same height.

Both the primary ribs and the secondary ribs to extend at the same angle with respect to the longitudinal tube axis. In another embodiment, the primary and secondary ribs extend at different angles with respect to the longitudinal tube axis.

Testing has shown that primary ribs should run at an angle $\geqq 20°$ but $\leqq 90°$ with respect to the longitudinal tube axis. The primary ribs preferably extend at an angle between 20° and 40° with respect to the longitudinal tube axis.

Also with regard to the course of the secondary ribs, internal testing indicates that the secondary ribs should optimally extend at an angle $\geqq 20°$, but $\leqq 90°$ with respect to the longitudinal tube axis. In this case, the secondary ribs also preferably run at an angle between about 20° and 40° with respect to the longitudinal tube axis.

Both the primary ribs and the secondary ribs have rounded summits and planar flanks. This is of particular advantage for when an exchanger tube is inserted, for example, into the lamellae of a heat exchanger, particularly through widening by means of a tool moved through the exchanger tube, the rounded summits of the primary and secondary ribs are only insignificantly flattened. This measure effectively combats the formation of hard-to-remove condensate films.

The flanks of the primary ribs transition into the beds of the channels by way of rounded chamfers. Similarly, the flanks of the secondary ribs transition into the beds of the channels via rounded chamfers. These features also contribute substantially to the optimization of heat exchange between the fluid flowing in the exchanger tube and the wall of the exchanger tube.

A narrow rib contour can be used. Accordingly, the flank angle of the primary and secondary ribs is 20° and 40°, preferably 25°.

The invention recognizes that, when the primary ribs extend at an appropriate angle with respect to the longitudinal tube axis and alternate with lower secondary ribs that follow one another in the circumferential direction, the ratio of the spacing of the center longitudinal planes of two adjacent primary ribs to the radial extension of the secondary ribs is of special significance. This ratio is 15:1 to 8:1, preferably 10:1. In this connection, it has proven to be particularly useful to dimension the spacing of the center longitudinal planes of two adjacent primary ribs to be between approximately 0.8 mm and 2.0 mm.

The radial extension of the primary ribs advantageously measures between approximately 0.15 mm and 0.40 mm.

The flow relationships in the channels between the primary and secondary ribs are further improved by the dimensioning of the ratio of the radial extension of the primary ribs to that of the secondary ribs to be approximately 3:1.

The cross-section-related surface ratio of the primary ribs relative to the secondary ribs is also important in attaining especially good heat transfer. Therefore, the surface ratio of the primary to secondary ribs is approximately 15:1 to 5:1, preferably 8:1 to 6:1.

As explained above, the secondary ribs can extend at the same angle with respect to the longitudinal tube axis as the primary ribs. If, however, the secondary ribs do not extend at the same angle with respect to the longitudinal tube axis as the primary ribs, it is advantageous for the spacing between adjacent secondary ribs to be a maximum of 10 mm.

At least the beds of the channels are roughened. It is also within the scope of the invention to roughen all of the primary and secondary rib surfaces, as with a degree of microroughness. This type of roughness is especially noticeable during condensation and evaporation of refrigerants if the exchanger tube is incorporated into a corresponding heat exchanger. Because of the large rib surfaces, the microroughness advantageously provides for large number of projections, edges, points and depressions that assure effective evaporation without necessitating larger quantities of material on the other side.

It is advantageous that the depth of the troughs correspond to the radial extension of the primary or secondary ribs. The troughs formed into adjacent primary or secondary ribs preferably extend coaxially one behind the other.

The production of an exchanger tube according to the invention is facilitated in that the cross section of the troughs corresponds approximately to the cross section of the rib regions separating two adjacent troughs. In this connection, the troughs and the rib regions preferably have a triangular cross section. Additionally, the concave trough beds are more sharply curved than the summits of the rib regions.

The exchanger tube according to the invention can be used in a preferred application comprising copper or a copper alloy. The exchanger tube can have a round or oval-shaped cross section. Round exchanger tubes preferably have an outside diameter of about 6 mm to 20 mm.

In other applications, it may be desirable to produce the exchanger tube from aluminum or an aluminum alloy, or from iron or an iron alloy.

BRIEF DESCRIPTION OF THE DRAWINGS

For a more complete understanding of this invention, reference should now be made to the embodiments illustrated in greater detail in the accompanying drawings and described below. In the drawings:

FIG. 6 is a graph showing a performance comparison of coaxial condensers equipped with different inside tubes.

DETAILED DESCRIPTION

Figure 1:
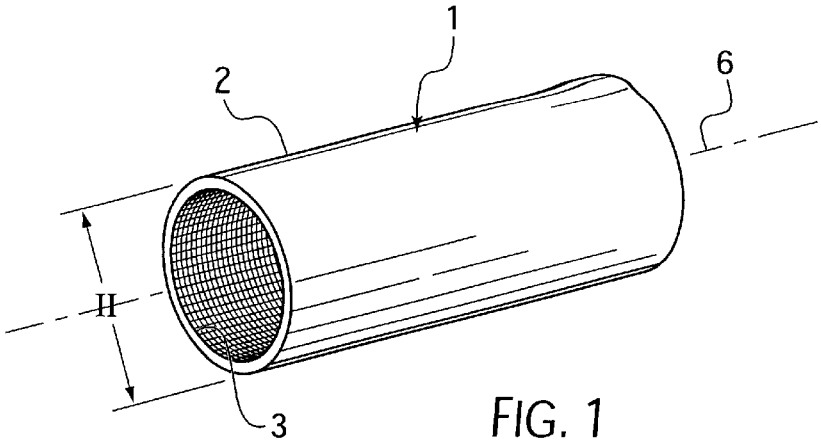
FIG. 1 is a perspective view of a longitudinal section of an exchanger tube constructed according to the principles of the invention.

In FIG. 1, reference numeral 1 indicates a longitudinal section of a longitudinally seam-welded exchanger tube for a heat exchanger (not further shown) that is typically used for condensation and evaporation of refrigerants.

Exchanger tube 1 comprises an oxygen-free, phosphorous deoxidized copper (SF—Cu soft). Its outside diameter D is 9.52 mm. Exchanger tube 1, whose outside and inside cross sections are circular, has a smooth outside surface 2 and a structured inside surface 3.

Figure 2:
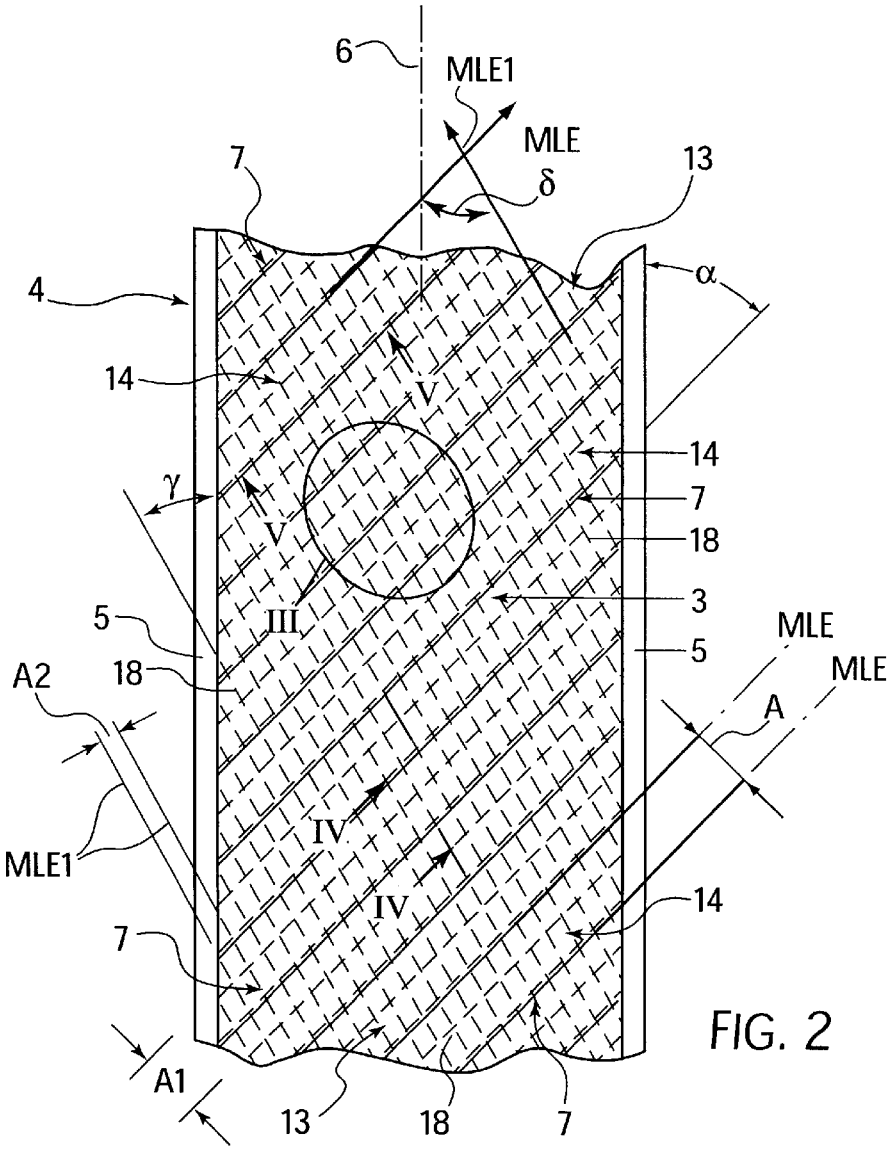
FIG. 2 is a plan view of a longitudinal section of a structured sheet band for forming an exchanger tube of the type illustrated in FIG. 1.

Exchanger tube 1 is produced from an SF—Cu sheet band, not shown in detail, which is planar on both sides. As can be seen in FIGS. 2 and 3, the sheet band is subjected to a single-stage stamping process, during which one side of the now-formed sheet band 4 remains smooth (this side later becomes the exterior surface 2 of exchanger tube 1), and the other side is provided with a structured surface (later to become the interior surface 3 of the exchanger tube 1). Only the edge regions 5 of sheet band 4 (FIG. 2), which are subsequently welded together, remain unstructured. Following stamping, sheet band 4 is formed into a slit tube and then seam-welded and partitioned longitudinally.

Figure 3A:
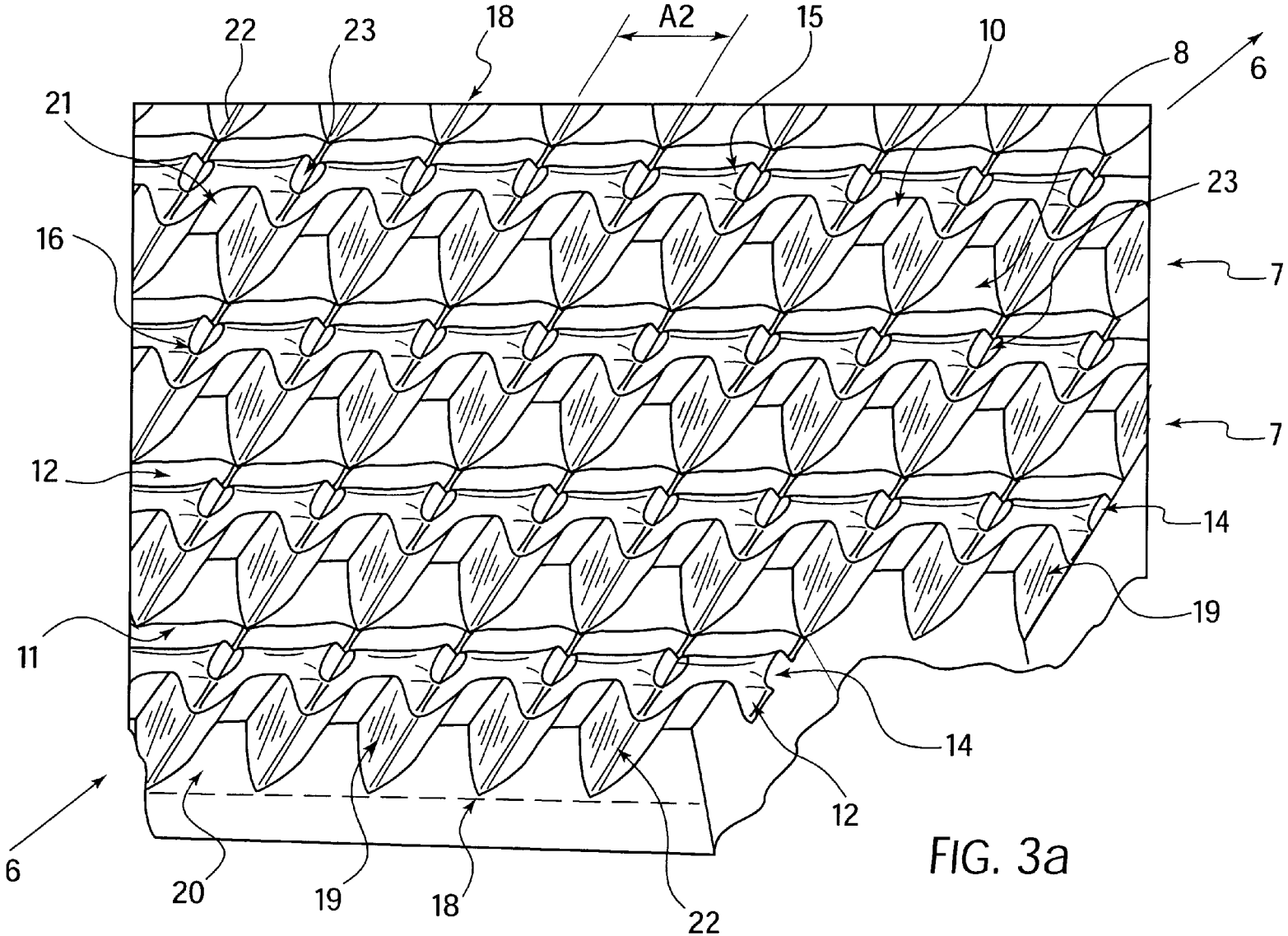
FIGS. 3*a* and 3*b* are magnified perspective views of a section of the surface of the tube taken from FIG. 2, taken from two different perspectives.

The structure of the interior surface 3 of exchanger tube 1 (see FIGS. 2 through 5) includes parallel primary ribs 7 (FIGS. 2 through 4) that run at an angle $\alpha$ of 25° with respect to the longitudinal axis 6 of exchanger tube 1 and have inclined flanks 8 (FIGS. 3*a*/*b* and 4). In the embodiment, the flank angle $\beta$ of primary ribs 7 is 25°, and the spacing A of the center longitudinal planes MLE of two adjacent primary ribs 7 is 1.0 mm (FIG. 4). Their height H (i.e., their radial extension) is 0.30 mm (FIG. 4). The wall 9 of exchanger tube 1 that connects primary ribs 7 is 0.30 mm thick (FIG. 4).

Figure 3B:
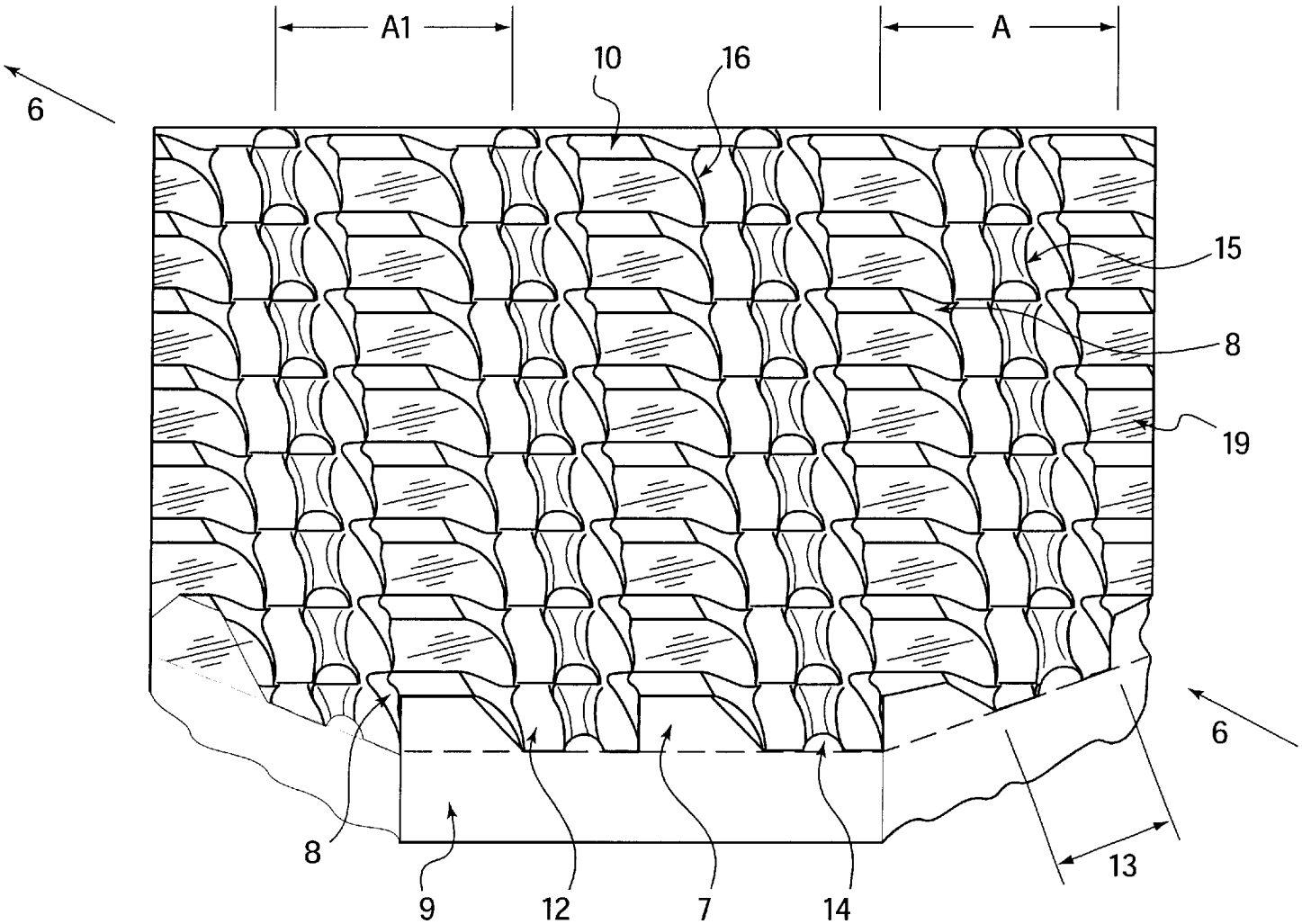
Figure 4:
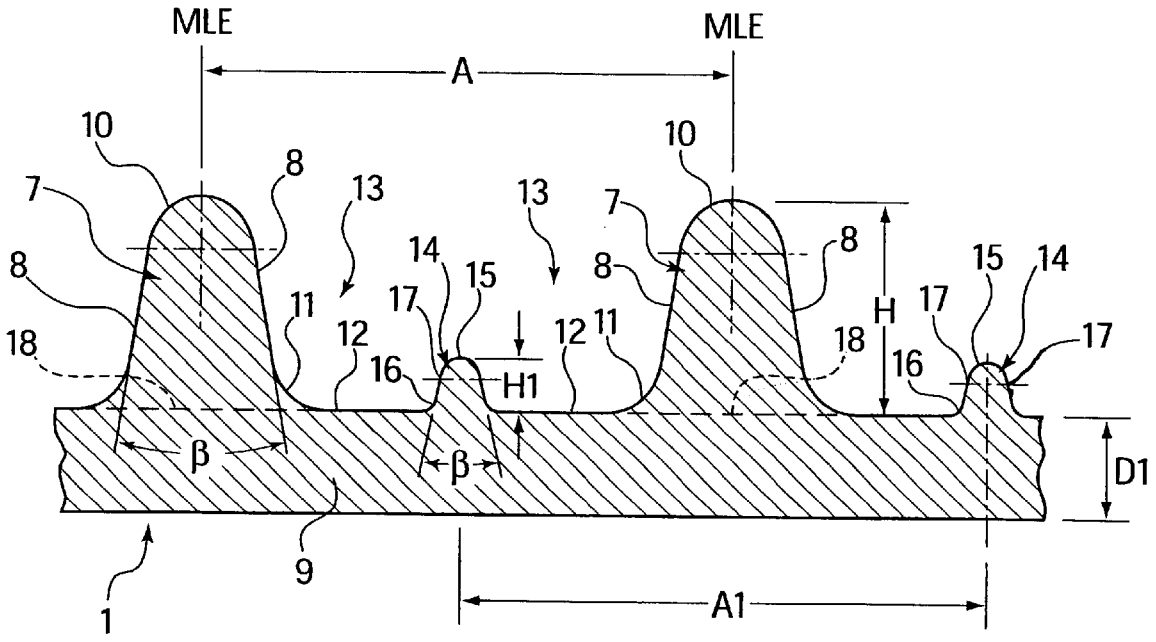
FIG. 4 is an enlarged representation of a vertical cross section of the tube taken along line IV—IV of FIG. 2.

Longitudinal axis 6 of the exchanger tube is included in FIGS. 3*a* and 3*b* to clarify the respective viewing direction. It can further be seen from FIGS. 3*a* and 3*b* that the summits 10 of primary ribs 7 are level. The chamfers 11 forming the transition between flanks 8 and the level beds 12 of the channels 13 are rounded (FIG. 4). The cross section volume of primary ribs 7 is dimensioned to be clearly less than that of channels 13 between primary ribs 7.

FIGS. 2 through 4 further illustrate that smaller-dimensioned secondary ribs 14 extend at a height HI (radial extension) between two adjacent primary ribs 7. The height Hi of the secondary ribs 14 is 0.10 mm. The summits 15 of secondary ribs 14 are also rounded, as are the chamfers 16 between flanks 17 of secondary ribs 14 and beds 12 of channels 13. Like flank angle $\beta$ of primary ribs 7, flank angle $\beta$ is 25°.

Secondary ribs 14 run at the same angle $\alpha$ with respect to longitudinal tube axis 6 as primary ribs 7. Spacing A1 of parallel secondary ribs 14 corresponds to spacing A of parallel primary ribs 7 (FIG. 2).

Figure 5:
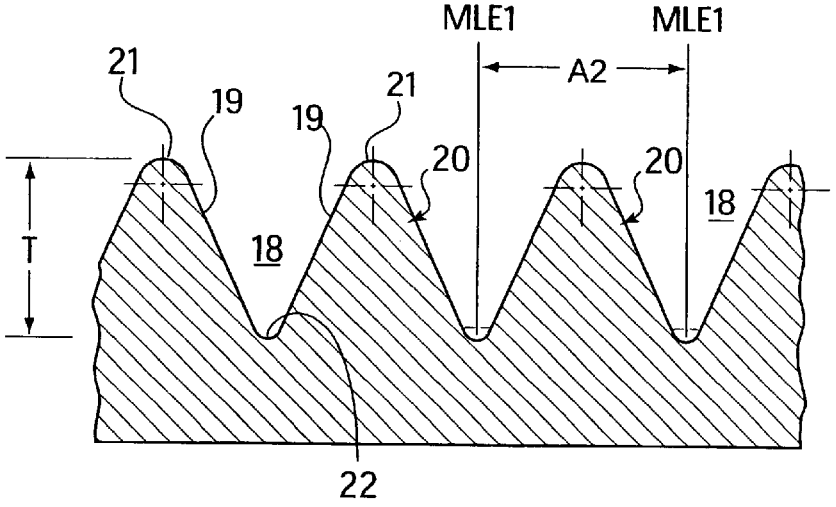
FIG. 5 is an enlarged representation of a vertical cross section taken along line V—V of FIG. 2.

As illustrated along the longitudinal sections in FIGS. 3*a* and 5, each primary rib 7 is provided with parallel troughs 18 having a triangular cross section. As FIG. 2 shows in this connection, troughs 18 of adjacent primary ribs 7 are disposed one behind the other so as to be aligned at an angle y of 35° with respect to longitudinal tube axis 6. The angle $\delta$ formed between the center longitudinal plane MLE of primary ribs 7 and the center longitudinal planes MLE1 of troughs 18 is 60°. The spacing A2 between two troughs 18 that are adjacent in the longitudinal direction of a primary rib 7 is 0.4 mm (FIGS. 2 and 5).

Troughs 18 have a depth T, which corresponds to height H of primary ribs 7. The flanks 19 of troughs 18 are planar. Trapezoidal rib regions 20, whose summits 21 are level, are formed between troughs 18. The floors 22 of troughs 18 are rounded (FIG. 5).

As shown in FIG. 3*a*, secondary ribs 14 also have troughs 23 that correspond to the arrangement and configuration of troughs 18 in primary ribs 7. Thus, troughs 23 will not be explained below.

At least beds 12 of channels 13 are provided with degree of surface microroughness; the microroughness is produced directly during stamping.

Due to the structured inside surface 3, the exchanger tube 1 illustrated in FIG. 1 has a significantly better heat transfer coefficient k' ($W/m^2K$) (FIG. 6), not only in comparison to an exchanger tube 24 having a smooth inside surface, but also in comparison to an exchanger tube 25 (standard commercial V-profile) merely having grooves on the inside.

This effect is readily apparent from the graph of FIG. 6, which is based on comparative testing of the tubes.

What is claimed is:

1. An exchanger tube for a heat exchanger having a longitudinal axis, an exterior surface, and an interior surface comprising:

rows of primary ribs running at an angle (α) with respect to the longitudinal tube axis, the primary ribs having a radial height H1 and inclined flanks;

rows of secondary ribs running at an angle with respect to the longitudinal tube axis, the secondary ribs having a radial height H2 and inclined flanks;

channels that are delimited laterally by the primary and secondary ribs; and troughs that extend transversely through the primary and secondary ribs, said troughs including inclined flanks, wherein the troughs extend at an angle (γ) with respect to the longitudinal tube axis;

wherein H1 is greater than H2.

2. The exchanger tube as defined in claim 1, wherein both the primary ribs and the secondary ribs run at the same angle (α) with respect to the longitudinal tube axis.

3. The exchanger tube as defined in claim 1, wherein the primary ribs run at an angle (α)≧20° and ≦90° with respect to the longitudinal tube axis.

4. The exchanger tube as defined in claim 1, wherein the primary ribs run at an angle (α) between 20° and 40° with respect to the longitudinal tube axis.

5. The exchanger tube as defined in claim 1, wherein the secondary ribs run at an angle (α)≧20°≦90° with respect to the longitudinal tube axis.

6. The exchanger tube as defined claim 1, wherein the secondary ribs run at an angle (α) of between 20° to 40°, with respect to the longitudinal tube axis.

7. The exchanger tube as defined in claim 1, wherein both the primary ribs and the secondary ribs have rounded summits and planar flanks.

8. The exchanger tube as defined in claim 1, wherein the flanks of the primary ribs transition into beds of the channels by way of rounded chamfers, and the flanks of the secondary ribs transition into beds of the channels by way of rounded chamfers.

9. The exchanger tube as defined in claim 7, wherein the flanks of the primary ribs transition into beds of the channels by way of rounded chamfers, and the flanks of the secondary ribs transition into beds of the channels by way of rounded chamfers.

10. The exchanger tube as defined in claim 1, wherein the flank angle (β) of the primary ribs and the secondary ribs is 20° to 40°.

11. The exchanger tube as defined in claim 1, wherein the flank angle (β) of the primary ribs and the secondary ribs is 25°.

12. The exchanger tube as defined in claim 1, wherein the ratio of the spacing of the center longitudinal planes of two adjacent primary ribs to the radial extension of the secondary ribs is 15:1 to 8:1.

13. The exchanger tube as defined in claim 1, wherein the ratio of the spacing of the center longitudinal planes of two adjacent primary ribs to the radial extension of the secondary ribs is 10:1.

14. The exchanger tube as defined in claim 1, wherein the spacing of the center longitudinal planes of two adjacent primary ribs is between about 0.8 mm and 2.0 mm.

15. The exchanger tube as defined in claim 1, wherein the radial extension of the primary ribs is between 0.15 mm and 0.40 mm.

16. The exchanger tube as defined in claim 1, wherein the ratio of the radial extension of the primary ribs to the radial extension of the secondary ribs is dimensioned to be approximately 3:1.

17. The exchanger tube as defined in claim 1, wherein—seen in cross section—the surface ratio of the primary ribs to that of the secondary ribs is dimensioned to be approximately 15:1 to 5:1.

18. The exchanger tube as defined in claim 1, wherein—seen in cross section—the surface ratio of the primary ribs to that of the secondary ribs is dimensioned to be approximately 81:1 to 6:1.

19. The exchanger tube as defined in claim 1, wherein when the course of the primary ribs and the secondary ribs deviates with respect to the angle from the longitudinal tube axis, the spacing between two adjacent secondary ribs is a maximum of 10 mm.

20. The exchanger tube as defined in claim 1, wherein at least the beds of the channels are roughened.

21. The exchanger tube as defined in claim 1, wherein the depth of the troughs corresponds to the radial height of the primary ribs or the radial extension of the secondary ribs.

22. The exchanger tube as defined in claim 1, wherein the cross section of the troughs approximately corresponds to the cross section of the rib regions separating two adjacent troughs.

23. The exchanger tube as defined in one claim 1, wherein the troughs and the rib regions have a triangular cross section.

24. The exchanger tube as defined in claim 1, wherein the beds of the troughs are more sharply curved than the summits of the rib regions.

25. The exchanger tube as defined in claim 1, wherein the tube comprises copper or a copper alloy.

26. The exchanger tube as defined in claim 1, wherein the tube comprises aluminum or an aluminum alloy.

27. The exchanger tube as defined in one of claim 1, wherein the tube comprises iron or an iron alloy.

* * * * *

UNITED STATES PATENT AND TRADEMARK OFFICE

CERTIFICATE OF CORRECTION

PATENT NO. : 6,308,775 B1
DATED : October 30, 2001
INVENTOR(S) : Ulrich Naumann

It is certified that error appears in the above-identified patent and that said Letters Patent is hereby corrected as shown below:

Column 4,
Line 41, change "HI" to -- H1 --.
Line 43, change "Hi" to -- H1 --.

Column 6,
Line 33, change "81:1" to -- 8:1 --.

Signed and Sealed this

Fourth Day of June, 2002

*Attest:*

*Attesting Officer*

JAMES E. ROGAN
*Director of the United States Patent and Trademark Office*